US006966676B2

(12) United States Patent
Chabert et al.

(10) Patent No.: US 6,966,676 B2
(45) Date of Patent: Nov. 22, 2005

(54) BALLOON FOR LIGHTED SIGN COMPRISING AN INFLATABLE ENVELOPE WITH SELF-REGULATED INTERNAL PRESSURE

(75) Inventors: Pierre Chabert, Saint Martin D'Heres (FR); Claude Jullin, La Combe de Lancey (FR); Jérôme Ruty, Echirolles (FR); Pascal Bordaz, Crolles (FR)

(73) Assignee: Airstar, Champ Pres Froges (FR)

( * ) Notice: Subject to any disclaimer, the term of this patent is extended or adjusted under 35 U.S.C. 154(b) by 181 days.

(21) Appl. No.: 10/644,925

(22) Filed: Aug. 21, 2003

(65) Prior Publication Data

US 2004/0042217 A1 Mar. 4, 2004

(30) Foreign Application Priority Data

Aug. 30, 2002 (FR) ..... 02 17064

(51) Int. Cl.[7] ..... F21S 13/10; F21V 1/06

(52) U.S. Cl. ..... 362/363; 362/431; 362/352; 362/96

(58) Field of Search ..... 362/96, 352, 363, 362/431; 446/220; 137/224

(56) References Cited

U.S. PATENT DOCUMENTS

| | | | | |
|---|---|---|---|---|
| 3,592,157 | A * | 7/1971 | Schwartz | 340/815.74 |
| 4,167,034 | A * | 9/1979 | Noguchi | 362/414 |
| 5,499,941 | A * | 3/1996 | Penjuke, Sr. | 446/222 |
| 6,012,826 | A * | 1/2000 | Chabert | 362/363 |

FOREIGN PATENT DOCUMENTS

| | | |
|---|---|---|
| EP | 0 771 729 A1 | 5/1997 |
| FR | 2754040 A1 | 4/1998 |
| FR | 2801092 A1 | 5/2001 |
| WO | WO 01/52453 A1 | 7/2001 |

* cited by examiner

*Primary Examiner*—Alan Cariaso
*Assistant Examiner*—Robert May
(74) *Attorney, Agent, or Firm*—Oliff & Berridge, PLC

(57) ABSTRACT

A balloon includes an envelope inflatable by a gas, in particular air, an anemometer for detection of the wind speed outside the envelope, and a control circuit to control a fan so as to make the internal inflation pressure of the envelope vary according to the wind speed. The upper part of the mast passes vertically through the envelope to give the latter a static rigidity at the level of the diametrically opposed bottom pole and top pole. The mast is hollow and includes at least one air outlet orifice in its upper part to perform inflation of the envelope.

10 Claims, 5 Drawing Sheets

BALLOON FOR LIGHTED SIGN COMPRISING AN INFLATABLE ENVELOPE WITH SELF-REGULATED INTERNAL PRESSURE

BACKGROUND OF THE INVENTION

According to the invention, the upper part of the mast passes vertically through the envelope to give the latter a static rigidity at the level of the diametrically opposed bottom pole and top pole, the mast being hollow and comprising at least one air outlet orifice in its upper part to perform inflation of the envelope by the electro-pneumatic means.

STATE OF THE PRIOR ART

The document FR 2,754,040 describes a self-inflating lighting balloon wherein the inflating system comprises an air supercharger integrated inside the envelope. The balloon inflates and lights up automatically in about ten seconds. The balloon support is formed by a perch fixed to an external end-piece of the bottom pole of the envelope. The bulb is of the halogen type and is protected by a grid giving the balloon structure a mechanical rigidity effect. The diameter of the envelope is about 1 metre for a weight of a few kilos. The internal air pressure is substantially constant, due to continuous operation of the supercharger. Such a balloon presents small dimensions perfectly suitable for lighting work sites and emergency operations.

OBJECT OF THE INVENTION

The object of the invention is to achieve an inflatable lighting balloon with an envelope of large volume having an optimum wind resistance regardless of the height of the mast.

According to the invention, the top part of the mast passes vertically through the envelope to give the latter a static rigidity at the level of the diametrically opposed bottom pole and top pole, the mast being hollow and comprising at least one air outlet orifice in its top part to perform inflation of the envelope by the electro-pneumatic means.

The balloon further comprises means for detecting the wind speed outside the envelope and a control circuit connected to the means for detecting the wind speed to control the electro-pneumatic means so as to make the internal inflation pressure of the envelope vary according to the wind speed. The control circuit is arranged to emit either an inflation pressure increase signal when the wind speed increases or an inflation pressure reduction signal when the wind speed decreases.

According to a preferred embodiment of the invention, the means for detecting the wind speed comprise an anemometer arranged at the top pole of the balloon. The mechanical static rigidity is advantageously completed by the self-regulated dynamic rigidity of the envelope due to modulation of the internal inflation pressure according to the wind speed. The twofold effect of static and dynamic rigidity of the envelope gives the balloon a very good wind resistance.

Other features can be used either separately or in combination:

- the electro-pneumatic means comprise a variable airflow fan arranged in an electrical cabinet at the foot of the mast and connected to the control circuit by an electrical connection extending inside the mast;

- the electric lamp is securedly affixed to the upper part of the mast inside the envelope;
- the bottom pole of the envelope acting as traverse for the mast comprises two semi-circular half-flanges associated with a pair of zip fasteners for access to the inside of the envelope;
- the top pole of the envelope is equipped with a positioning washer bearing on a circular support plate at the top of the mast, said plate also acting as support for the anemometer;
- the upper part of the mast comprises a plurality of rungs constituting an internal ladder between the two poles;
- the mast has a compartment subjected to atmospheric pressure for housing a ballast and starting circuit of the lamp, said compartment being separated from the internal duct of the mast by a foam plug so as to enable maintenance of the ballast and starting circuit to be performed without stopping pressurization of the envelope.

BRIEF DESCRIPTION OF THE DRAWINGS

Other advantages and features will become more clearly apparent from the following description of an embodiment of the invention, given as a non-restrictive example only, and represented in the accompanying drawings in which.

DESCRIPTION OF A PREFERRED EMBODIMENT

Figure 1:
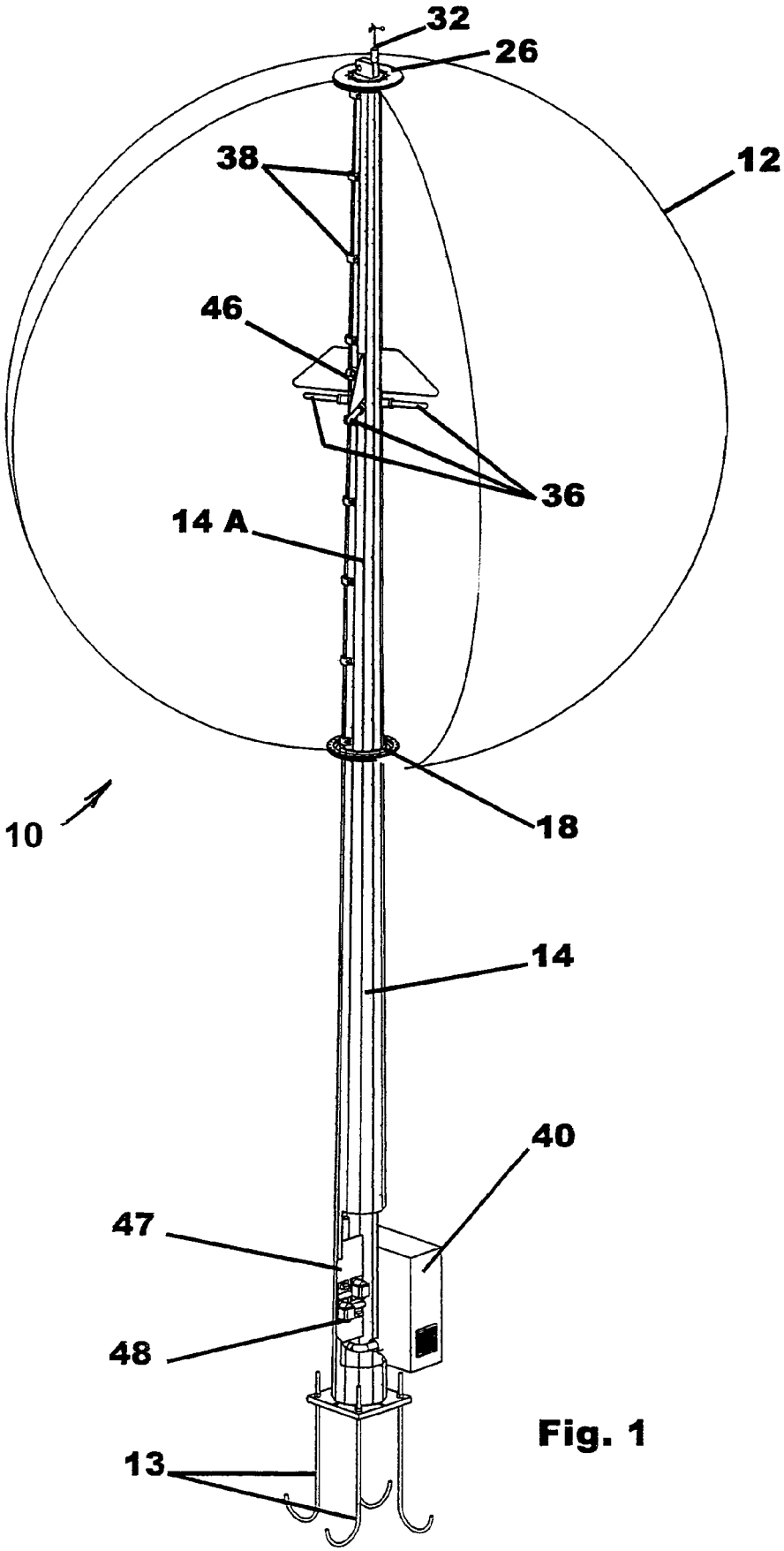
FIG. 1 is an elevational view of the inflatable balloon according to the invention, the envelope being partially cut-away.

With reference to the figures, a balloon 10 for a lighted sign is composed of an envelope 12 inflatable by a gas and a vertical support mast 14 anchored to the ground by steel armatures 13.

The envelope 12 is made of translucent flexible plastic material having a pre-determined volume after inflation, for example a spherical or elliptic shape. The filling gas is air blown inside the envelope 12 by electro-pneumatic blowing means 15 notably comprising an electric fan 16 or compressor. Any other filling gas can be used.

The metal mast 14 is hollow over its whole height and preferably has an upwardly decreasing cross-section. It is formed by one or more aluminium or steel sections, the upper part 14A whereof passes through the envelope 12 in the vertical diametrical direction.

Figure 4:
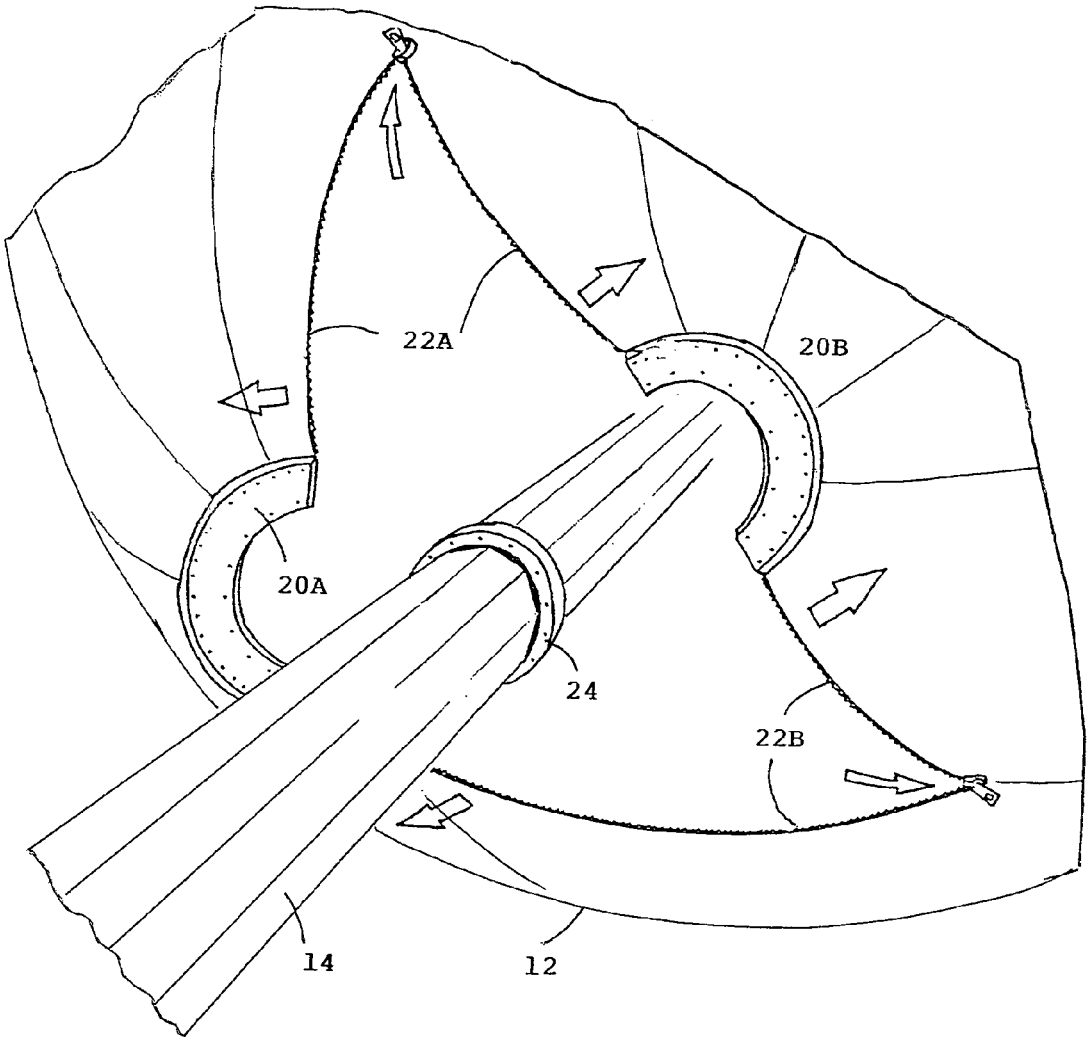
FIG. 4 is a partial perspective view of the bottom pole of the envelope.
Figure 5:
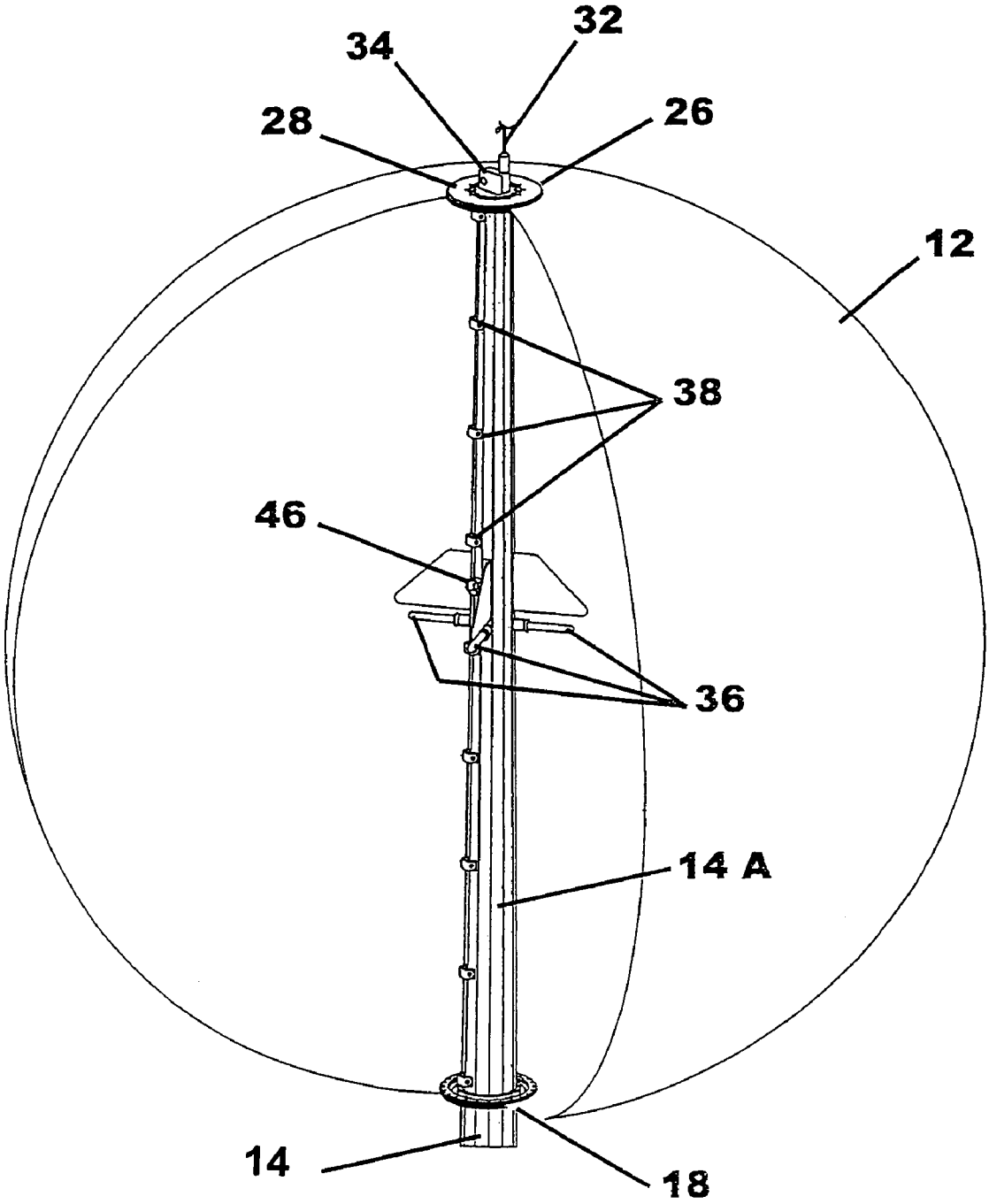
FIG. 5 shows an internal view of the envelope wherethrough the mast passes.

The bottom pole 18 of the envelope 12 acts as traverse for the mast 14 and comprises for this purpose two half-flanges 20A, 20B of semi-circular shape joined to a pair of zip fasteners 22A, 22B. Opening of the zip fasteners 22A, 22B (FIG. 4) enables the two half-flanges 20A, 20B to be separated for access to the inside of the envelope 12. To blank off the access hole, the zip fasteners 22A, 22B simply have to be closed causing the half-flanges 20A, 20B to move towards one another and then to come into contact against an annular stop 24 integral to the mast 14. This position then enables the envelope 12 to be inflated (FIG. 5).

Figure 2:
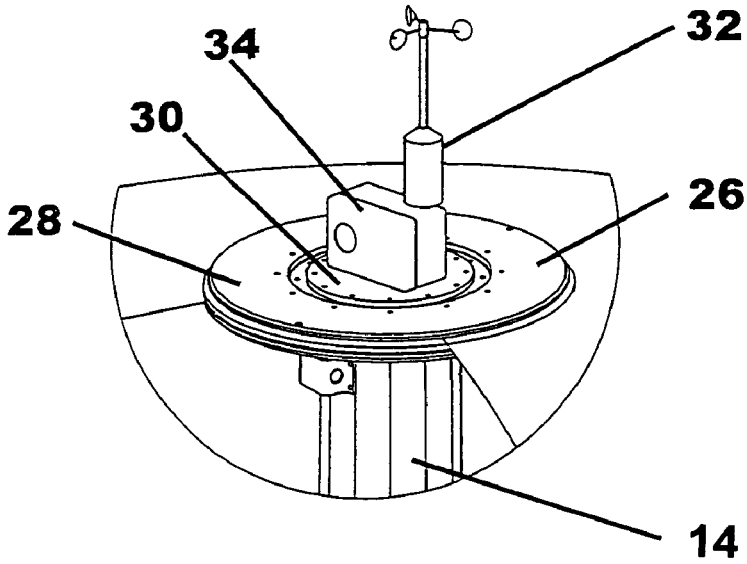
FIG. 2 shows a detailed view on an enlarged scale of the top of the mast.
Figure 3:
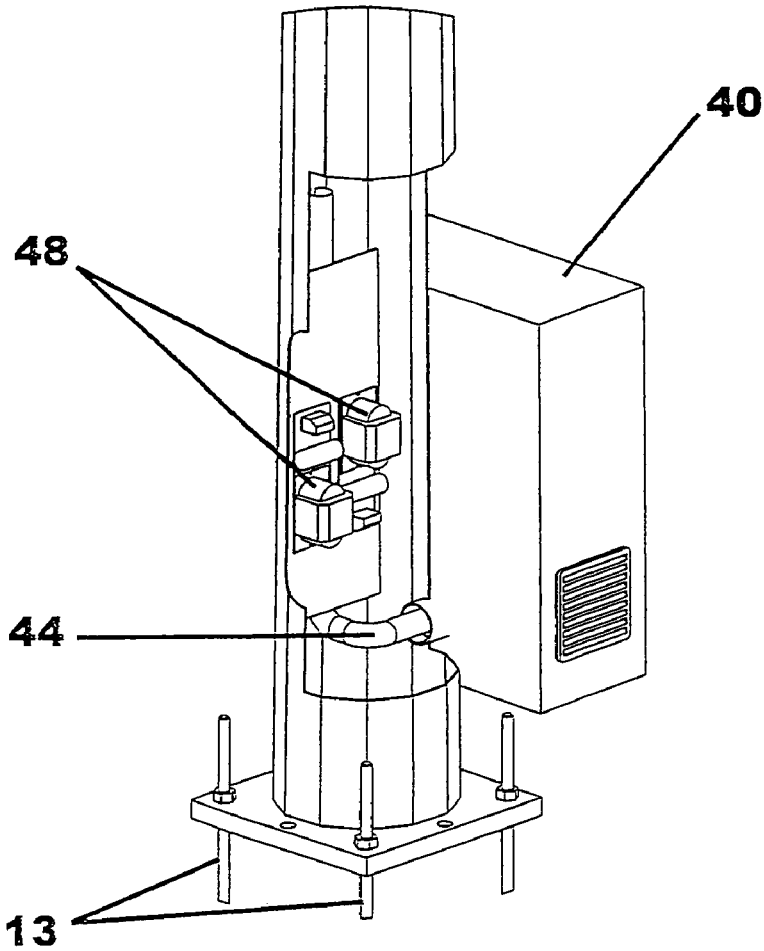
FIG. 3 represents a detailed view on an enlarged scale of the foot of the mast.

The top pole 26 of the envelope 12 is equipped with a positioning washer 28 (FIGS. 2 and 5) bearing on a circular support plate 30 at the top of the mast 14. An anemometer 32 arranged outside the envelope 12 is fixed onto the plate 30 to continually measure the wind speed. The anemometer 32 is connected at the level of the plate 30 to a control circuit 34 designed to operate the electro-pneumatic means 15 to modulate the internal inflation pressure of the envelope 12 according to the speed of the wind. The anemometer 32 can be replaced by any other wind speed detection means.

The upper part 14A of the mast 14 situated inside the envelope 12 between the two poles 26, 18 is equipped with at least one electric lamp 36 (four in the example of FIG. 1 or 5) preferably situated in the centre of the envelope 12. Rungs 38 are staggered along the upper part 14A of the mast 14 to form an internal ladder between the two poles 26, 18.

The lighting lamps 36 can be of the electromagnetic radiation, discharge in a gas, or incandescent bulb type. Electrical connections (not shown) inside the mast 14 connect the lamps 36 and the control circuit 34 to a power supply cabinet 40 located at the foot of the mast 14.

Figure 6:
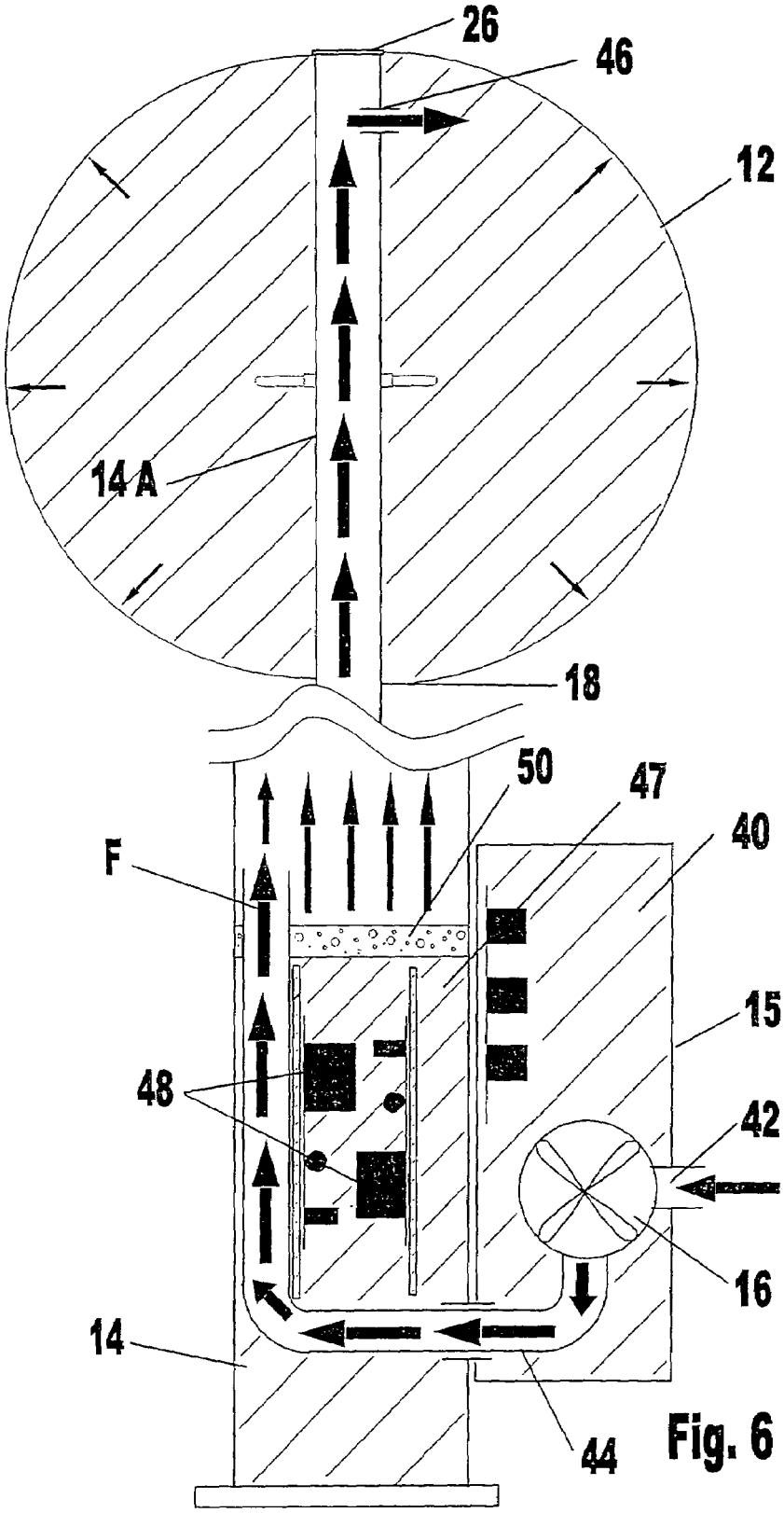
FIG. 6 illustrates the principle of inflation of the envelope through the hollow mast.

The cabinet 40 contains the variable airflow fan 16, the monitoring and protection circuits, and the power circuit of the lamps 36. The fan 16 is equipped with an air inlet orifice 42 at atmospheric pressure and with an outlet duct 44 passing through the rear wall of the cabinet 40 and ending up inside the mast 14, through which there thus passes an upward flow of pressurized air (see arrow F, FIG. 6) coming from the fan 16.

Inflation of the envelope 12 is performed via at least one outlet orifice 46 provided in the upper part 14A of the mast 14, preferably above the lamps 36.

The foot of the mast 14 contains a compartment 47 wherein there is housed a ballast and starting circuit 48 of the lamps 36. The compartment 47 is at atmospheric pressure, being separated from the internal duct of the mast 14 by a foam plug 50. Maintenance of the ballast and starting circuit 48 can thus be performed without stopping pressurization of the envelope 12.

Operation and implementation of the lighting balloon 10 according to the invention are as follows:

When installation of the balloon 10 is performed, the zip fasteners 22A, 22B of the envelope 12 are opened for the upper part 14A of the mast 14 to pass through.

At the level of the poles 18, 26, the twofold securing of the envelope 12 on the opposite ends of the pass-through mast 14A enables the balloon 10 to be given a static rigidity which secures the envelope 12 firmly to the mast 14. In the closed position of the zip fasteners 22A, 22B, the envelope 12 is not totally tight and allows a small amount of air to escape when the fan 16 operates. The air is drawn in from the outside environment through the inlet orifice 42 and discharged to the inside of the envelope 12 by means of the outlet duct 44 and the outlet orifice 46 of the mast 14. In the inflated state of the envelope 14 (FIG. 6), the relative internal air pressure is about 10 millibars. Power supply of the lamps 36 for lighting the balloon 10 is then made possible.

This mechanical static rigidity is advantageously completed by a self-regulated dynamic rigidity of the envelope 12 due to modulation of the internal inflation pressure according to the wind speed. The anemometer 32 at the top of the balloon 10 cooperates with the control circuit 34 to transmit to the fan 16 either an inflation pressure increase signal when the wind speed increases or a reduction signal of said pressure when the wind speed decreases. The speed of the drive motor of the fan 16 simply has to be adjusted to make the air flow injected into the envelope 12 vary.

The diameter of the envelope 12 can reach 5 metres for a mast 14 having a height of 10 metres. The twofold static and dynamic rigidity of the envelope 12 gives the balloon 10 a very good wind resistance.

What is claimed is:

1. A balloon, comprising:

an envelope made of translucent flexible material and being inflatable by a gas;

a mast for supporting the envelope;

lighting means having at least one electric lamp arranged inside the envelope;

means for electrical power supply of the lamp; and electro-pneumatic blowing means for inflating the envelope, wherein an upper part of the mast passes vertically through the envelope to give the envelope a static rigidity at the level of the diametrically opposed bottom pole and top pole, the mast being hollow throughout a majority of a length of the mast and having at least one air outlet orifice in the upper part to perform inflation of the envelope by the electro-pneumatic blowing means.

2. The balloon according to claim 1, further comprising means for detecting a wind speed outside the envelope, and a control circuit connected to the means for detecting the wind speed to control the electro-pneumatic blowing means so as to make an internal inflation pressure of the envelope vary according to the wind speed.

3. The balloon according to claim 2, wherein the control circuit is arranged to emit either an inflation pressure increase signal when the wind speed increases or an inflation pressure reduction signal when the wind speed decreases.

4. The balloon according to claim 2, wherein the means for detecting the wind speed comprises an anemometer arranged at the top of the balloon.

5. The balloon according to claim 1, wherein the electro-pneumatic blowing means comprises a variable airflow fan arranged in an electrical cabinet at a foot of the mast and connected to a control circuit by an electrical connection extending inside the mast.

6. The balloon according to claim 1, wherein the electric lamp is securedly affixed to the upper part of the mast inside the envelope.

7. The balloon according to claim 1, wherein the bottom pole of the envelope acting as traverse for the mast comprises two semi-circular half-flanges associated with a pair of zip fasteners for access to the inside of the envelope.

8. The balloon according to claim 4, wherein the top pole of the envelope is equipped with a positioning washer bearing on a circular support plate at a top of the mast, the circular support plate also acting as support for the anemometer.

9. The balloon according to claim 1, wherein the upper part of the mast comprises a plurality of rungs constituting an internal ladder between the bottom and top poles.

10. The balloon according to claim 1, wherein the mast has a compartment subjected to atmospheric pressure for housing a ballast and starting circuit of the lamp, said compartment being separated from an internal duct of the mast by a foam plug so as to enable maintenance of the ballast and starting circuit to be performed without stopping pressurization of the envelope.

* * * * *